US006365222B1

(12) United States Patent
Wagner et al.

(10) Patent No.: US 6,365,222 B1
(45) Date of Patent: Apr. 2, 2002

(54) ABRADABLE COATING APPLIED WITH COLD SPRAY TECHNIQUE

(75) Inventors: Gregg P. Wagner, Apopka; David B. Allen, Oviedo; Brij B. Seth, Maitland, all of FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/698,998

(22) Filed: Oct. 27, 2000

(51) Int. Cl.[7] ..... B05D 1/06

(52) U.S. Cl. ..... 427/140; 427/142; 427/191; 427/203; 427/205; 148/537

(58) Field of Search ..... 427/470, 475, 427/140, 142, 180, 191, 192, 203, 205; 134/7; 148/516, 537

(56) References Cited

U.S. PATENT DOCUMENTS

| | | | |
|---|---|---|---|
| 2,149,253 | A | 3/1939 | Cooper |
| 3,455,510 | A | 7/1969 | Rotolico |
| 3,754,976 | A | 8/1973 | Babecki et al. |
| 3,880,550 | A | 4/1975 | Corey et al. |
| 4,063,742 | A | 12/1977 | Watkins, Jr. |
| 4,382,811 | A | 5/1983 | Luscher et al. |
| 4,409,054 | A | 10/1983 | Ryan |
| 4,416,421 | A | 11/1983 | Browning |
| 4,430,360 | A | 2/1984 | Bill et al. |
| 4,552,784 | A | 11/1985 | Chu et al. |
| 4,566,700 | A | 1/1986 | Shiembob |
| 4,610,698 | A | 9/1986 | Eaton et al. |
| 4,619,845 | A | 10/1986 | Ayers et al. |
| 4,669,954 | A | 6/1987 | Habarou et al. |
| 4,679,981 | A | 7/1987 | Guibert et al. |
| 4,714,622 | A | 12/1987 | Omori et al. |

(List continued on next page.)

OTHER PUBLICATIONS

M.F. Smith, et al. Cold Spray Direct Fabrication —High Rate, Solid State, Materiasl Consolidation, Proc. of Fall 1998 Meeting of the Material Research Soc., Boston, MA. Nov. 30–Dec. 4, 1998.

D. L. Gilmore, et al. Particle Velocity and Deposition Efficiency in the Cold Spray Process, JTTEE5 8:576–582 (Submitted 1 Dec. 1998; in revised form May 21, 1999).

H. Kreye, T. Stoltenhoff, Cold Spraying —A Study of Process and Coating Characteristics, Universitat der Bundeswehr, Hamburg, Germany. No Date.

R.C. Dykhuizen and M.F. Smith, Gas Dynamic Principles of Cold Spray (Submitted 10 Sep. 1997; in revised form Mar. 9, 1998).

R.C. Dykhuizen, et al. Impact of High Velocity Cold Spray Particles (Submitted Nov. 20, 1998; in revised form May 12, 1999).

Dr. Mark F. Smith, Overview of Cold Spray, Cold Spray Workshop Albuquerque, NM Jul. 14–15, 1999.

Mark F. Smith, et al. Thermal Spray at Sandia, Process & Materials Development to Support the D.O.E. and U.S. Industrial Competitiveness. No Date.

Sandia's approach to cold spray research thermal spray research laboratory. No Date.

*Primary Examiner*—Fred J. Parker

(57) ABSTRACT

A cold spray process (20) for applying an abradable coating (16) to a substrate material (12). A bond coat layer (14) and/or an abradable coating material layer (16) are applied to a substrate (12) by directing particles of the material toward the substrate surface at a velocity sufficiently high to cause the particles to deform and to adhere to the surface. Particles of the bond coat material may first be directed toward the substrate surface at a velocity sufficiently high to clean the surface (24) but not sufficiently high to cause the particles to deform and to adhere to the surface.

16 Claims, 2 Drawing Sheets

U.S. PATENT DOCUMENTS

| | | | | |
|---|---|---|---|---|
| 4,764,089 | A | | 8/1988 | Strangman |
| 4,854,196 | A | | 8/1989 | Mehan |
| 4,863,345 | A | | 9/1989 | Thompson et al. |
| 4,865,252 | A | | 9/1989 | Rotolico et al. |
| 4,867,639 | A | | 9/1989 | Strangman |
| 4,914,794 | A | | 4/1990 | Strangman |
| 4,964,568 | A | | 10/1990 | Rotolico et al. |
| 4,999,225 | A | | 3/1991 | Rotolico et al. |
| 5,006,321 | A | | 4/1991 | Dorfman et al. |
| 5,024,884 | A | | 6/1991 | Otfinoski |
| 5,048,183 | A | | 9/1991 | Cang et al. |
| 5,113,582 | A | | 5/1992 | Monson et al. |
| 5,210,944 | A | | 5/1993 | Monson et al. |
| 5,262,206 | A | * | 11/1993 | Rangaswamy et al. |
| 5,293,717 | A | | 3/1994 | Snyder et al. |
| 5,302,414 | A | | 4/1994 | Alkhimov et al. |
| 5,304,032 | A | | 4/1994 | Bosna et al. |
| B15,302,414 | A | | 4/1994 | Alkhimov et al. |
| 5,326,647 | A | | 7/1994 | Merz et al. |
| 5,350,557 | A | | 9/1994 | Jarrabet et al. |
| 5,364,543 | A | | 11/1994 | Bosna et al. |
| 5,434,210 | A | * | 7/1995 | Rangaswamy et al. |
| 5,472,315 | A | | 12/1995 | Alexander et al. |
| 5,506,055 | A | | 4/1996 | Dorfman et al. |
| 5,516,586 | A | | 5/1996 | Singer et al. |
| 5,536,022 | A | | 7/1996 | Sileo et al. |
| 5,596,912 | A | | 1/1997 | Laurence et al. |
| 5,704,759 | A | | 1/1998 | Draskovich et al. |
| 5,730,806 | A | | 3/1998 | Caimi et al. |
| 5,780,116 | A | | 7/1998 | Sileo et al. |
| 5,780,171 | A | | 7/1998 | Nissley et al. |
| 5,782,414 | A | | 7/1998 | Nathenson |
| 5,795,626 | A | | 8/1998 | Gabel et al. |
| 5,817,267 | A | | 10/1998 | Covino et al. |
| 5,845,846 | A | | 12/1998 | Watanabe et al. |
| 5,883,314 | A | | 3/1999 | Sievers et al. |
| 5,899,660 | A | | 5/1999 | Dodd |
| 5,951,892 | A | | 9/1999 | Wolfla et al. |
| 5,962,076 | A | | 10/1999 | Mason et al. |
| 5,975,845 | A | | 11/1999 | Ball |
| 5,980,659 | A | * | 11/1999 | Kawaura et al. |
| 5,997,248 | A | | 12/1999 | Ghasripoor et al. |
| 6,015,586 | A | | 1/2000 | Omori et al. |
| 6,038,900 | A | | 3/2000 | Miyasaka |
| 6,089,825 | A | | 7/2000 | Walden et al. |
| 6,102,656 | A | | 8/2000 | Nissley et al. |
| 6,103,186 | A | | 8/2000 | Sievers et al. |

* cited by examiner

ABRADABLE COATING APPLIED WITH COLD SPRAY TECHNIQUE

This invention relates generally to the field of materials technology, and more specifically to the field of abradable coatings, and in particular to a process for manufacturing a turbine component by applying an abradable coating using a cold spray technique, and to a turbine component manufactured with such a process.

BACKGROUND OF THE INVENTION

Abradable coatings are well known in the art. An abradable coating may be applied to a component that is subject to rubbing or abrasion during the operation of the component. The abradable coating is selected to be softer than the material of the underlying component and the material of the rubbing structure. As a result of its mechanical properties, the abradable coating will wear preferentially in lieu of the wearing of the underlying material or the rubbing structure. By purposefully causing an interference fit between the two structures, the abradable coating will be caused to wear to a minimum clearance fit, thereby acting as a seal between the two structures.

It is known that the efficiency of a turbine engine depends to a large degree upon minimizing the leakage of the working fluid from a desired flow path. As used herein, the term turbine may include any type of aero-rotary machine, such as a steam turbine, combustion turbine, compressor, etc.

Primary sources of such working fluid leakage are the clearances between moving and stationary parts within a turbine. Although a close tolerance fit may be obtained by fabricating the mating parts to a very close tolerance range, such fabrication processes are very costly and time consuming. Furthermore, as an engine cycles through its speed and power ranges it will experience temperature transients that can result in a temporary change in dimensions, and with very tight tolerances can result in an unplanned contact between moving and stationary parts. Abradable coatings have become an industry standard for controlling the size of such clearances. The function of such a coating is to provide a rub-tolerant surface that minimizes the damage to the rubbing parts, and can thereby permit the nominal gap between such parts to be minimized.

It is known to apply an abradable coating to the inner diameter surface of a compressor blade ring forming part of a gas turbine engine. The abradable coating is much softer than the material of the compressor blade tips, therefore, any interference between the blade tips and the blade ring will result in the preferential wearing of the abradable coating, concomitantly establishing a blade tip seal. The substrate material of a compressor blade ring is typically a carbon steel. A common abradable coating for this application is nickel-graphite, such as 85% nickel 15% graphite by weight. The carbon in this material acts as a lubricant during the wearing of the abradable coating surface. A bond coat is necessary between the carbon steel material of the blade ring and the coating of abradable material to prevent the corrosion of the underlying carbon steel. Because abradable coatings are by design somewhat porous, they will allow moisture and other corrosive materials to migrate into contact with the carbon steel. Any corrosion caused by such exposure of the carbon steel can cause spalling of the abradable coating.

To apply such an abradable coating to a compressor blade ring, it is known to clean the substrate surface to remove any corrosion or oxidation products. Such cleaning may be accomplished by grit blasting with alumina particles. A nickel-aluminum bond coat, typically 5% by weight aluminum, is then applied to the cleaned carbon steel substrate. The bond coat may be applied by any one of several thermal spray processes, including flame spray, air plasma spray (APS) and high velocity oxy-fuel (HVOF). Such processes propel the bond coat material in a molten or semi-molten state against the surface of the substrate where it cools and solidifies to form a coating. Although it is desirable to completely seal the surface of the carbon steel with the bond coating layer, such thermal spray processes often produce a coating having some porosity. The abradable coating is then applied to the bond coat material, again by a thermal spraying process. Care must be taken when applying the bond coat layer and the abradable material layer to prevent the warping or ovalization of the blade ring due to differential heating/cooling of the component.

The known processes for applying abradable coatings have numerous limitations, such as the creation of coating layers containing voids and porosity, the need for specialized thermal spraying equipment that is not easily adaptable for field repair operations, and a high cost of manufacturing. For certain components such as a blade ring, the high temperature of the thermal spraying process can cause distortion of the component. Thus, an improved process is needed for manufacturing components having an abradable coating.

BRIEF DESCRIPTION OF THE INVENTION

The present inventors have recognized that a cold spray process is beneficial for the application of an abradable coating system. The cold spraying of the bond coat layer of an abradable coating system provides an oxidation and corrosion resistant coating having less porosity than prior art bond coat layers. Because a cold spray process produces a bond coating having essentially no porosity, the performance of the overlying abradable coating will be improved when compared to prior art flame sprayed coatings because the incidence of spalling will be reduced.

For components sensitive to warping or distortion, the use of a cold spraying process for both the bond coat layer and the abradable material layer eliminates any concern of heat induced deformation.

Because the area to which a coating is applied may be limited and controlled during a cold spraying process, an abradable coating may be applied to only a selected area of a component without the need for masking of the areas not to be coated.

The porosity of a layer of abradable material may be controlled to a desired value by controlling the parameters of a cold spray process.

The halo effect of particles along the edges of a cold spray of particles provides a final cleaning of the surface to be coated. This final cleaning is especially beneficial when coating a carbon steel component, since even a small amount of oxidation forming after an initial grit blasting process will reduce the adhesion of an overlying bond coat. The use of a cold spray process not only provides this final cleaning action, but it also eliminates the oxidation effects of a thermal spray process.

A portion of the carbon in a nickel graphite abradable material will be oxidized during a thermal spraying process and will escape as carbon monoxide or carbon dioxide gas. An abradable coating produced by cold spraying a nickel graphite powder will contain more of the beneficial carbon than a similar coating produced by thermally spraying the same powder. Since no loss of carbon occurs during cold spray, very precise control of composition is achieved.

These and other features and advantages of the invention are provided by way of example, not limitation, and are described more fully below.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

U.S. Pat. No. 5,302,414 dated Apr. 12, 1994, and re-examination certificate B1 5,302,414 dated Feb., 25, 1997, describe a cold gas-dynamic spraying method for applying a coating, also referred to as cold spraying. That patent describes a process and apparatus for accelerating solid particles having a size from about 1–50 microns to supersonic speeds in the range of 300–1,200 meters per second and directing the particles against a target surface. When the particles strike the target surface, the kinetic energy of the particles is transformed into plastic deformation of the particles, and a bond is formed between the particles and the target surface. This process forms a dense coating with little or no thermal effect on the underlying target surface. Accordingly, the '414 patent does not teach or suggest the use of a cold spray process for applying an abradable coating, since abradable coatings will purposefully contain voids that function to improve the abrasion characteristics of the material.

Figure 1:
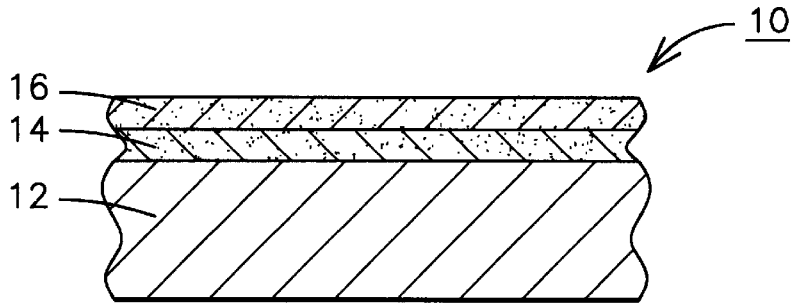
FIG. 1 is a cross-sectional view of a portion of a component having an abradable coating.
Figure 2:
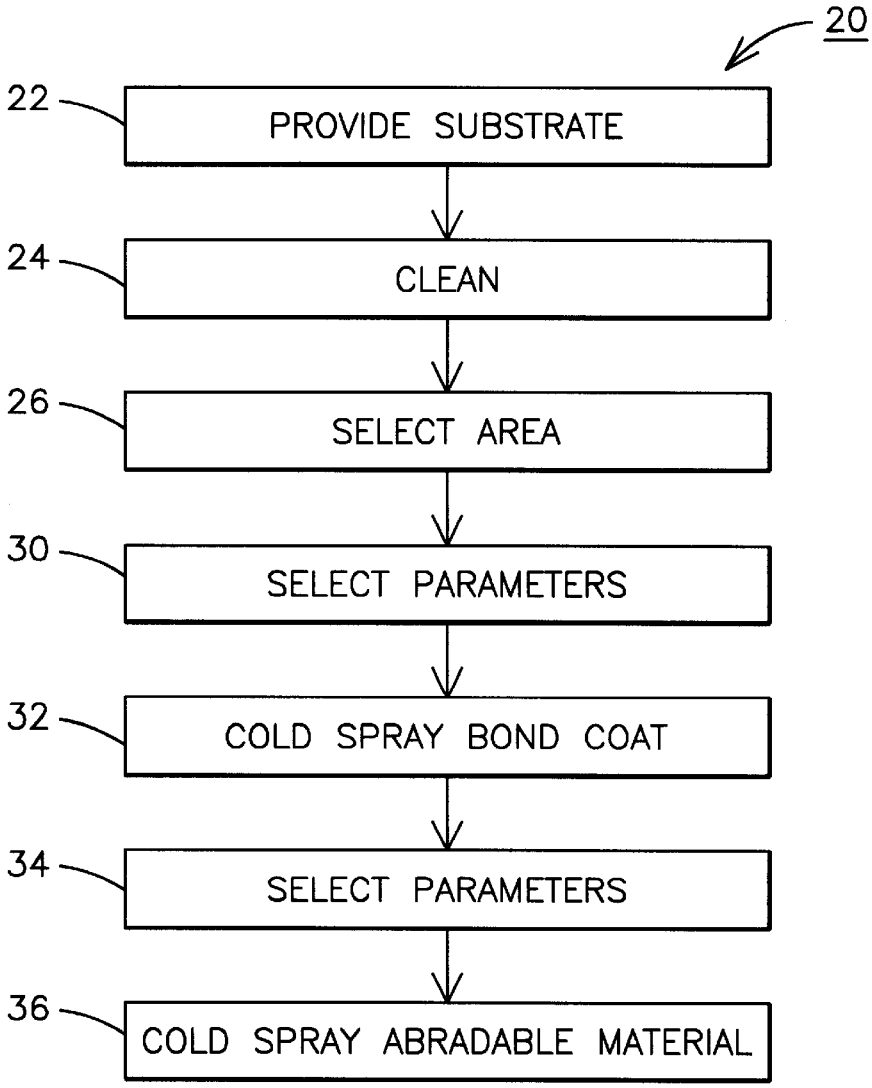
FIG. 2 illustrates the steps of a manufacturing process for applying an abradable coating to a component.

The present inventors have recognized that a cold spray process provides certain benefits for the application of the layers of an abradable coating system. The cross-section of a portion of a component 10 having a coating of an abradable material applied by a cold spray process is illustrated in FIG. 1, and the process for producing component 10 is illustrated in FIG. 2.

Figure 3:
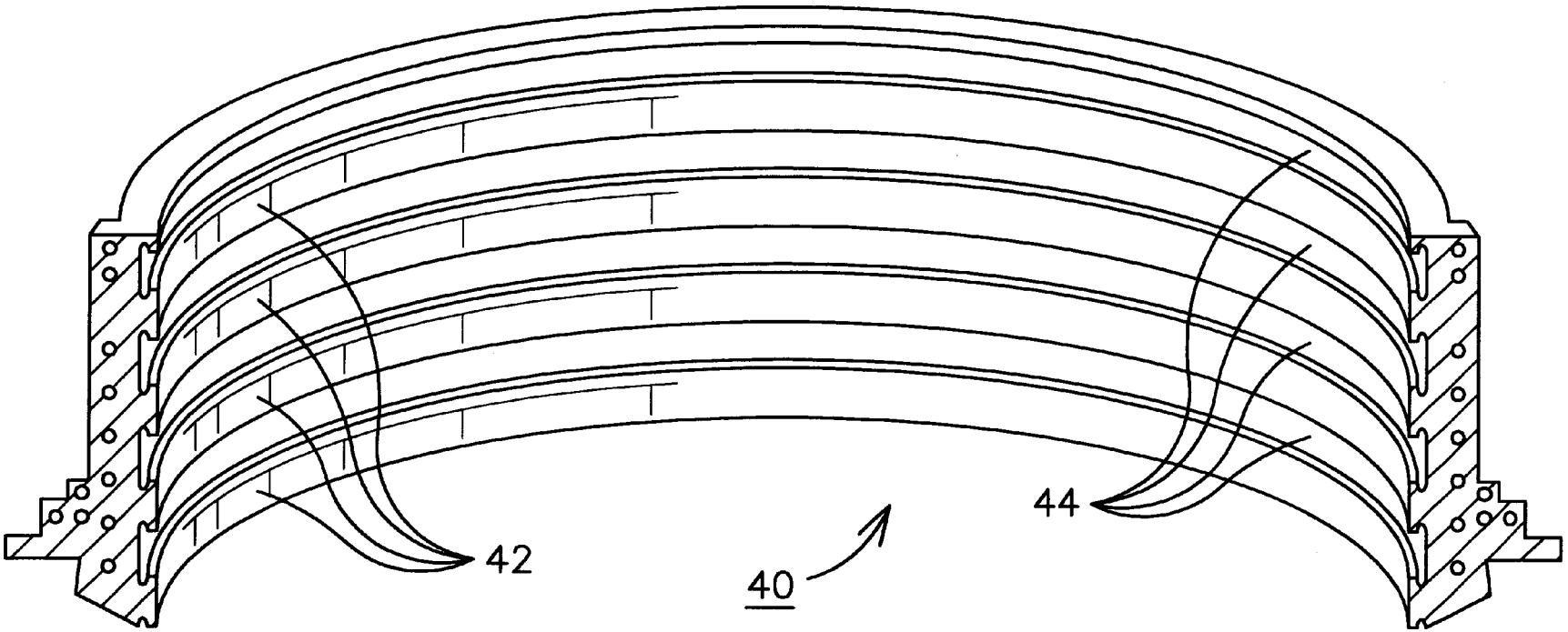
FIG. 3 is a perspective view of a compressor blade ring segment having an abradable coating applied to selected surface areas by a cold spray process.

Component 10 is formed by first supplying a substrate material 12 at step 22 and forming the substrate material 12 into a desired shape, such as a shape useful in a turbine. In one embodiment, a carbon steel substrate 12 is formed into a compressor blade ring 40 for a gas turbine engine, as illustrated in FIG. 3. The surface of the substrate material 12 is cleaned at step 24 to remove any contaminant or corrosion product. Cleaning step 24 may be accomplished by any process known in the art, such as grit blasting with alumina particles. Areas of the component 10 to which an abradable material will be applied are then selected at step 26.

For the compressor blade ring 40 of FIG. 3, there are four blade tip wear areas 42 where it is desired to have an abradable coating. Conversely, in the groove areas 44 it is preferred to have no such coating. With prior art thermal spray processes, it was necessary to mask those areas 44 where no coating was desired due to the radial spread of the thermally sprayed material. Because it is necessary to retain the material particles within the hot gas of a thermal torch for a predetermined time in order to ensure that the particles have reached the desired temperature, the target surface must be held a specified distance away from the torch head nozzle. This distance is typically several inches. At that distance from the nozzle, there is a considerable over spray region, and the pattern of deposition of the thermally sprayed material is not a sharp line as the nozzle moves across the target surface. To avoid coating the groove areas 44 during a thermal spray process, it is known to apply a mask in those areas 44 prior to subjecting the target areas 42 to the thermal spray process. The jet diameter in a cold spraying process can be held much tighter because no heating of the particles is required, therefore, the working distance between the nozzle and the target surface can be much smaller, for example 25 mm. Thus, the need for masking of adjacent areas is minimized or eliminated by using a cold spray process for applying an abradable coating.

A layer of bond coat material 14 may then be applied to the substrate 12. The bond coat material 14 may be stainless steel or nickel-aluminum, for example. In one embodiment, nickel with about 5% aluminum is used as the bond coat material 14. The process parameters for cold spraying the bond coat material 14 are selected at step 30. Variable parameters may include the particle size and shape, the velocity and temperature of the acceleration gas, the nozzle design, the angle of impact of the particles upon the surface of the substrate 12, the speed of travel of the nozzle, the number of layers to be sprayed, etc. Such parameters may be selected to maximize the density of the bond coat 14 and to minimize the occurrence of voids therein. The bond coat 14 is applied to the selected portion of the surface of substrate 12 by a cold spray process at step 32. The surface of the bond coat 14 then becomes the target surface for the abradable coating material layer 16. The cold spray process includes the step of directing particles of the bond coat material having a predetermined size range, such as from about 1 to about 50 microns, toward a target surface of the component at a velocity sufficiently high to cause the particles to deform and to adhere to the target surface. The velocity of the particles is selected by considering the angle of attack of the particles, since it is the perpendicular approach velocity that must be sufficiently high to cause the particles to deform and to adhere to the target surface.

An abradable material layer 16 is then applied to the bond coat layer 14. The abradable material layer 16 may be any such material known in the art. In one embodiment the abradable material layer is 85% nickel and 15% graphite, with the nickel being clad over graphite flakes. The parameters for cold spraying the abradable material layer 16 onto the bond coat 14 are selected at step 34, with the variable parameters including those described above for step 30. The layer of abradable material 16 is cold sprayed onto the bond coat layer 14 at step 36 using the process parameters selected at step 34. Particles of the abradable material having a predetermined size range, such as from about 1 to about 50 microns, are directed toward a target surface of the bond coat layer 14 at a velocity sufficiently high to cause the particles to deform and to adhere to the target surface. A predetermined amount of porosity may be desired for the abradable material layer 16, and the spray process variables may be selected accordingly. For example, by increasing the velocity of the particle impact onto the target surface the density of the coating may be increased, and by decreasing the velocity of the particle impact onto the target surface the density of the coating may be decreased. Similarly, the use of a larger particle size may result in a coating that is less dense than one formed with smaller particles. The coating porosity may also be achieved by incorporating particles of an additional material, such as a polymer, into the abradable material. After spraying is complete, the additional material may be removed by heating to a sufficient temperature to burn off the polymer, leaving voids behind. An advantage of this technique is that it could allow increased particle velocity, increasing the adhesion and integrity of the abradable layer, and still produce an acceptable level of porosity. The size of the voids and the percentage of porosity in the abradable layer would be determined by the selection of the size and quantity of polymer in the initial powder.

When thermal spray processes are used to apply an abradable coating of material containing carbon, such as nickel graphite, carbon monoxide and/or carbon dioxide gas will be produced by the oxidation of a portion of the graphite (carbon) in the hot propulsion gas. It is known that as much as one third of the available carbon can be lost during a thermal spray process. For the application of an abradable coating, this carbon loss is undesirable, since the carbon provides a desired lubricating effect when the coating is subjected to abrasion. The abradable coating layer 16 applied by a cold spray process at step 36 will contain essentially the same percentage of carbon as the particles introduced into the spray. Accordingly, an abradable coating 16 applied by a cold spray process will perform better than a coating formed by thermal spraying of the same particles.

To optimize the adhesion of the bond coat layer 14 to the substrate material 12, it is desired to have a metal to metal contact between the layers. Any contamination, oxidation or corrosion existing on the surface of the substrate 12 may adversely impact the adhesion of the bond coat layer 14. Step 24 will remove the majority of surface contamination from the substrate layer 12. However, after even a short period of exposure to moisture in air, a carbon steel surface will be begin to oxidize. Handling or storing of the component after the cleaning step 24 may introduce additional contaminants to the previously clean surface. The environment of the prior art thermal spraying processes also contributes to the oxidation of the substrate during the coating process due to the presence of high temperature, oxygen and other chemicals. The parameters selected at step 30 for the cold spray process of step 32 may be chosen to produce a desired halo effect of particles at the fringe of the spray area where the speed/angle of attack of the bond material particles are insufficient to cause the particles to bond to the surface of the substrate 12, but are sufficient to produce a desired grit blast/cleaning effect. The halo effect is caused by the spread of particles away from a nozzle centerline due to particle interaction. When the nozzle is directed perpendicular to the target surface, the halo may be generally circular around a generally circular coating area. The halo effect may also have an elliptical shape caused by a non-perpendicular angle between the nozzle centerline and the plane of the substrate target surface. The halo effect provides a cleaning of the substrate 12 just prior to the application of the bond coat layer 14, thereby improving the adhesion of the bond coat layer 14 when compared to a prior art device wherein some impurities or oxidation may exist between the bond coat layer and the substrate. The cleaning provided by the halo effect may be a second cleaning of the surface in addition to the cleaning of step 24. In some applications the cleaning step 24 may be eliminated and the cleaning of the substrate accomplished solely by the halo effect in step 36.

The cold spraying steps 32,36 may be accomplished with much simpler tooling than prior art thermal spray processes. Because cold spraying does not involve high temperatures or combustible gases, the cold spray process may be adapted to field applications for the in-situ or on-site coating of in-service components. A component having an abradable coating may be removed from a turbine and inspected to identify those areas of the abradable coating needing repair. Those areas needing repair may be cleaned to expose the underlying substrate material, such as by local grinding or by local grit blasting. Because the cold spraying process can be controlled to cover only a predetermined area, only those portions of a component where excessive wear has occurred or where the abradable coating system has failed may be coated. A first coating of bond coat material may be applied by directing particles of the bond coat material toward the cleaned substrate surface at a velocity sufficiently high to cause the particles to deform and to adhere to the surface to be repaired. Here, again, the halo effect may be controlled to provide cleaning, either supplemental to grinding/grit blasting or in place thereof. Cleaning with the halo effect involves directing particles of the bond coat material toward the area needing repair at a velocity sufficiently high to clean but not sufficiently high to cause the particles to deform and to adhere to the area needing repair. Furthermore, because the cold spraying steps 32,36 do not cause heat-induced warping of the component, no special fixtures or productivity limiting process control steps are needed, thereby facilitating the use of this process in the field.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A process for applying an abradable coating to a component, the process comprising the steps of:

providing an abradable coating material in particle form; and cold spraying the particles of the abradable coating material toward a target surface of the component at a velocity sufficiently high to cause the particles to deform and to adhere to the target surface.

2. The process of claim 1, further comprising preparing the target surface of the component by the steps of:

providing a bond coat material in particle form;

cleaning the target surface of the component; and directing particles of the bond coat material toward the target surface at a velocity sufficiently high to cause the particles to deform and to adhere to the target surface.

3. The process of claim 2, further comprising the step of directing a portion of the particles of the bond coat material toward the target surface at a velocity sufficiently high to clean the substrate surface but not sufficiently high to cause the portion of the particles to deform and to adhere to the target surface.

4. The process of claim 2, wherein the step of cleaning further comprises the steps of:

performing a first cleaning operation by grit blasting the target surface of the component; and performing a second cleaning operation by directing a portion of the particles of the bond coat material toward the target surface at a velocity sufficiently high to clean the target surface but not sufficiently high to cause the portion of the particles to deform and to adhere to the target surface.

5. The process of claim 1, further comprising the step of controlling the velocity of the particles of the abradable coating material to cause the particles of the abradable coating material to adhere to the target surface to form a coating having a predetermined amount of porosity.

6. The process of claim 1, further comprising the step of controlling the size of the particles of the abradable coating material to cause the particles of the abradable coating material to adhere to the target surface to form a coating having a predetermined amount of porosity.

7. The process of claim 1, further comprising the steps of:

incorporating particles of a polymer material with the particles of the abradable coating material;

directing particles of the abradable coating material and the polymer material toward the target surface at a velocity sufficiently high to cause the particles to deform and to adhere to the target surface to form a coating of abradable coating material and polymer material; and heating the coating to remove the polymer material from the coating leaving a plurality of voids within the coating.

8. A process for manufacturing a turbine component, the process comprising the steps of:

forming a carbon steel substrate material into a shape useful in a turbine;

depositing a layer of bond coat material onto at least a portion of the substrate material by a cold spray process; and depositing a layer of an abradable coating material onto the layer of bond coat material.

9. The process of claim 8, further comprising the step of depositing the layer of an abradable coating material by a cold spray process.

10. The process of claim 9, further comprising the steps of:

performing a first cleaning operation by grit blasting the at least a portion of the substrate material after the step of forming; and performing a second cleaning operation on the at least a portion of the substrate material prior to the step of depositing a layer of bond coat material by directing particles of the bond coat material toward the substrate material at a velocity sufficiently high to clean the substrate material but not sufficiently high to cause the particles to deform and to adhere to the substrate material.

11. The process of claim 9, further comprising the steps of:

incorporating particles of a polymer material with particles of the abradable coating material;

directing particles of the bond coat material and the polymer material toward the target surface at a velocity sufficiently high to cause the particles to deform and to adhere to the target surface to form a coating of abradable coating material and polymer material; and heating the coating to remove the polymer material from the coating leaving a plurality of voids within the coating.

12. A method of repairing a turbine component comprising the steps of:

removing a component having an abradable coating from a turbine;

identifying an area of the abradable coating needing repair;

cleaning the area needing repair;

applying a repair coating of abradable material to the area needing repair by a cold spray process.

13. The method of claim 12, further comprising the steps of:

cleaning the area needing repair to expose an underlying substrate surface;

applying a repair coating of a bond coat material to the substrate surface by a cold spray process; and applying the repair coating of abradable material to the repair coating of bond coat material.

14. The method of claim 13, wherein the step of cleaning comprises directing particles of the bond coat material toward the area needing repair at a velocity sufficiently high to clean but not sufficiently high to cause the particles to deform and to adhere to the area needing repair.

15. A process for producing a component having an abradable coating containing a predetermined ratio of nickel to carbon, the process comprising the steps of:

identifying a desired ratio of nickel to carbon for an abradable coating;

providing particles of an abradable coating material having a predetermined size range, the particles having a ratio of nickel to carbon equal to the desired ratio; and cold spraying the particles of abradable coating material toward a component substrate surface at a velocity sufficiently high to cause the particles to deform and to adhere to the surface.

16. The process of claim 15, further comprising the step of:

providing particles of a bond coat material of a predetermined size; and directing the particles of bond coat material toward the component substrate surface at a velocity sufficiently high to cause the particles to deform and to adhere to the substrate surface to form a layer of bond coat material; and directing the particles of abradable coating material toward the component substrate surface at a velocity sufficiently high to cause the particles to deform and to adhere to the bond coat material.

* * * * *